United States Patent [19]

Veloni

[11] 4,273,024

[45] Jun. 16, 1981

[54] APPARATUS AND METHOD FOR EXTRACTING STUCK AMMUNITION CASES FROM SIZER DIES

[76] Inventor: Bob R. Veloni, Rte. 3, P.O. Box 862, Hoquiam, Wash. 98550

[21] Appl. No.: 71,889

[22] Filed: Sep. 4, 1979

[51] Int. Cl.[3] ..... F42B 33/10

[52] U.S. Cl. ..... 86/1 R; 81/3.05; 86/23; 86/24

[58] Field of Search ..... 81/3.05; 86/23, 24, 86/1 R

[56] References Cited

U.S. PATENT DOCUMENTS

| | | | |
|---|---|---|---|
| 3,702,089 | 11/1972 | Bachhuber | 86/23 X |
| 4,028,989 | 6/1977 | Vassallo | 86/23 X |

*Primary Examiner*—Leland A. Sebastian
*Attorney, Agent, or Firm*—Seed, Berry, Vernon & Baynham

[57] ABSTRACT

An extractor for removing an ammunition case from a sizer die in which the case is stuck after the gripping rim surrounding the head of the case has been broken. The extractor includes a body portion having a rim which is engaged by the end of a reloading ram. A screw projecting from the opposite end of the body portion is received by a threaded bore formed in the primer pocket of the case. The body portion is preferably hexagonally shaped so that it can be rotated ith a wrench to thread a screw into the primer pocket bore. Movement of the reloading ram away from the sizer die thus draws the case from the sizer die.

6 Claims, 5 Drawing Figures

APPARATUS AND METHOD FOR EXTRACTING STUCK AMMUNITION CASES FROM SIZER DIES

BACKGROUND OF THE INVENTION

1. Field of the Invention

This invention relates to the field of manually reloading ammunition cases, and more particularly to a device for removing cases which have become stuck in a sizer die during the reloading process.

2. Description of the Prior Art

Manual reloading of ammunition cases involves a number of steps which are necessary to restore the case to its original size and shape. One of these steps is a sizing and expanding operation in which the case is inserted into a sizer die using a reloading press. Basically, a reloading press includes a frame in which are mounted a sizer die and a reloading ram in spaced-apart, coaxial relation. The ammunition case is carried by the ram and inserted into the sizer die by actuating a pivotally mounted handle which is connected to the ram. The inner walls of the sizer die cause the outer walls of the ammunition case to assume its original size and shape. A projecting expander plug contacts the inner walls of the neck of the case to insure that it is round and of the proper diameter. Additionally, a primer ejector projecting from the expander plug removes the spent primer from the primer pocket of the case.

The case is normally secured to the ram by a shell holder which engages a gripping rim formed around the head of the case. Normally, the connection between the gripping rim and the shell holder is sufficiently strong to remove the ammunition case from the sizer die. Sometimes, however, the case becomes stuck in the sizer die and movement of the ram away from the sizer die rips the gripping rim from the head of the case. Since the sizer die is relatively expensive, it is undesirable to merely discard the sizer die. Instead, the case must be removed from the sizer die.

A variety of techniques have been developed for removing stuck cases from sizer dies, none of which are entirely satisfactory. At one end of the spectrum are techniques involving such tools as chisels and plyers used to pry or pull the case from the die. A more effective, but still unsatisfactory, technique employs a stuck case remover kit sold by RCBS, Inc. of Oroville, Calif. In accordance with the RCBS technique the sizer die is removed from the reloading press and the die expander-primer extractor projection is at least partially withdrawn from the case. The primer pocket (from which the primer has already been removed) is then drilled and tapped to form a threaded bore. A screw carried by a cylindrical member is then threaded into the primer pocket bore until the end of the cylindrical member contacts the end of the sizer die. Further rotation of the screw withdraws the case from the sizer die into a recess formed in the cylindrical member. The principal disadvantage of the RCBS technique is that the rotational force of the screw must not only overcome the frictional force between the case and sizer die, but it must also overcome the friction between the screw and the threads of the primer pocket bore. The threads of the primer pocket bore are sometimes not sufficiently strong to withstand these two forces so that the threads are sometimes stripped thereby compounding the problem of removing the case from the sizer die.

SUMMARY OF THE INVENTION

It is an object of the invention to provide an apparatus capable of removing an ammunition case from a sizing die when the case is so firmly stuck in the die that conventional techniques would be unusable.

It is another object of the invention to provide an apparatus and method of removing stuck cases from sizer dies which is adapted for use with the same equipment used in the reloading process in which the case became stuck so that special equipment is not required to generate the relatively strong forces needed to withdraw the case from the die.

It is still another object of the invention to provide a method and apparatus for removing stuck cases from sizing dies which is quick and convenient.

These and other objects of the invention are provided by the technique of boring a hole in the primer pocket of an ammunition cartridge which has been stuck in a sizing die. The bore is then tapped to form threads in the bore. An extracting device having a generally cylindrical body and an annular rim formed at one end is then mounted on the ram of a reloading press by inserting the rim into a slot formed at the end of the ram. A screw projecting from the opposite end of the body is then screwed into the threaded primer pocket bore by rotating the body. The ram is then moved away from the sizer die thereby withdrawing the stuck case from the sizer die. it is important to recognize that it is the movement of the ram—and not rotation of the body—that draws the case from the sizer die since rotation of the body terminates before the screw is axially stressed. The body preferably is in the shape of a polygon so that it may be rotated with the aid of a conventional wrench in order to thread the screw into the bore formed in the primer pocket. The screw preferably extends through a threaded bore formed along the axis of the body and is held in place by a set-screw threaded into the bore which forcibly contacts the first screw.

DETAILED DESCRIPTION OF THE INVENTION

Figure 1:
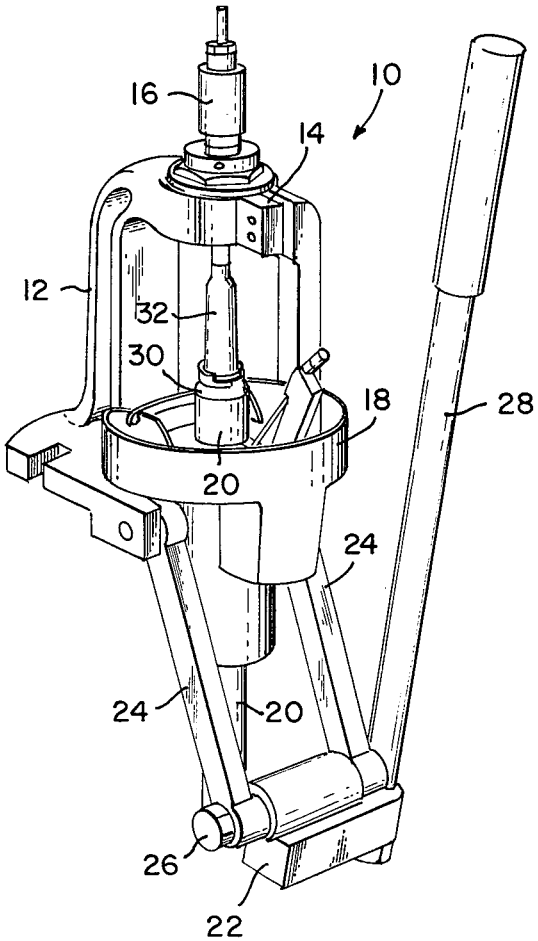
FIG. 1 is an isometric view of a reloading press saving a case mounted therein in preparation for sizing.

A press for use in the reloading of spent ammunition cases is illustrated in FIG. 1. The press 10 includes a frame 12 having an upper portion 14 in which a sizer die 16 is releasably secured and a lower portion 18 which slidingly receives a reloading ram 20. The reloading ram 20 extends downwardly through the lower portion 18 of the frame and is pivotally secured to an actuating link 22. The actuating link 22 is pivotally mounted by a conventional bearing between a pair of support arms 24 projecting downwardly from the frame 12. An actuating handle 28 projects from the actuating link 22 and is rotated to axially move the ram 20 within the lower portion of the frame 18. The ram 20 carries a shell holder 30 to which the spent case 32 is releasably secured. Clockwise rotation of the handle 28 as viewed in FIG. 1 causes upward movement of the ram 20 thereby forcing the case 32 into the sizing die 16 to restore the case 32 to its original size and shape. Counterclockwise rotation of the handle 28 normally withdraws the case 32 from the sizing die 16 for subsequent processing.

Figure 2:
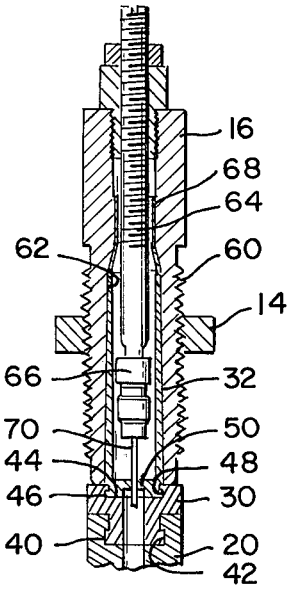
FIG. 2 is a cross-sectional view of the case inserted in the sizer die during the reloading operation.

With reference also now to FIG. 2, it will be noted that the case holder 30 has an annular ring 40 formed at one end which fits into an annular slot 42 formed at the end of the ram 20. As best illustrated in FIG. 1, a portion of the ram 20 around the rim is open to allow the shell holder 30 to slide into and out of the slot 42.

The case 32 is releasably secured to the case holder 30 by a similar structure. The blunt end of the case 30, known as the case head 44, has an annular gripping rim 46 which is received by an annular slot 48 formed in the case holder 30. The case 32 may thus be removed from the case holder 30 by merely sliding the rim 46 from the slot 48 formed in the case holder 30.

The structure of the sizer die 16 is also illustrated in greater detail in FIG. 2. The die 16 is generally cylindrical in configuration having threads 60 formed along its cylindrical wall which mate with threads formed in a bore in the upper portion 14 of the reloading press frame 12. The die 16 is substantially hollow having inner walls 62 of a precise size and shape which restore the outer surface of the case 32 to its original size and shape when the case 32 is forced into the sizer die 16. A projection 64 which extends into the interior of the case 32 has a two-fold purpose. First, it carries an expander 66 which precisely sizes and shapes the neck 68 of the case 32 when the case 32 is forced into the die 16. Second, a primer ejector 70 projecting from the expander 66 pushes a spent primer (not shown) from the primer pocket 50. The projection 64 is threaded into a bore in the die 16 so that it may be removed while the case 32 remains in the die 16 to allow the primer pocket 50 to be bored and tapped as explained hereinafter.

Figure 3:
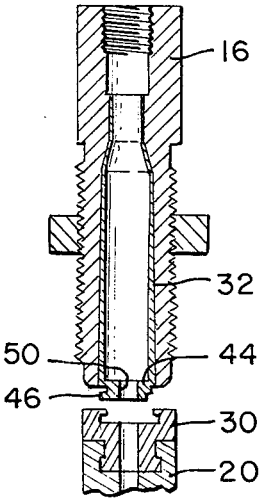
FIG. 3 is a cross-sectional view illustrating a case stuck in a sizer die having its gripping rim torn off by a shell holder which is mounted on the end of a reloading ram.

Although the case 32 is forced into the die 16 with substantial force, the gripping rim of the case 32 normally has sufficient strength to withstand movement of the case holder 30 away from the die 16 in order to withdraw the case 32 from the die 16. However, as illustrated in FIG. 3, sometimes either the case 32 becomes jammed in the die or the gripping rim 46 fatigues thereby causing the gripping rim 46 to be torn from the head 44 of the case 32 responsive to axial movement of the ram 20 away from the die 16. Heretofore it has been fairly difficult to remove the case 32 from the die 16 so that the die 16 can be subsequently used.

Figure 4:
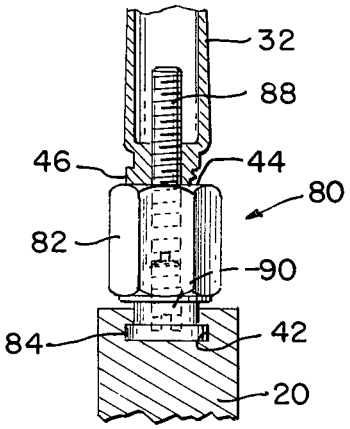
FIG. 4 is a cross-sectional view illustrating the extracting device mounted on the end of the reloading ram and engaging the stuck case for removal from the sizer die.
Figure 5:
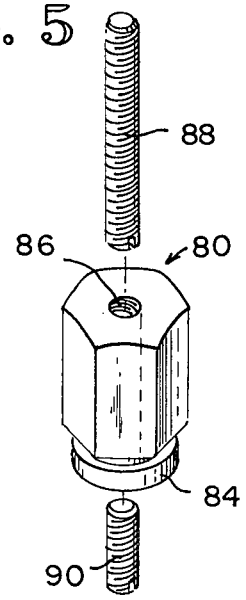
FIG. 5 is an exploded isometric view of the extracting device.

In accordance with the inventive case extracting technique as illustrated in FIGS. 3 and 4, the projection 64 (FIG. 2) is unscrewed from the die 16 to at least partially withdraw the projection 64 from the interior of the case 32. The primer pocket 50 is then drilled to form a bore of a predetermined size, and the bore 50 is tapped to form threads threrein of a predetermined size. The shell holder 30 is then removed from the ram 20, and the inventive extracting device 80 is mounted on the ram 20 as illustrated in FIG. 4. With reference, now, also to FIG. 5, the extracting device 80 includes a generally cylindrical body 82 which preferably has the shape of a hexagon or other polygon. One end of the body 82 has an annular rim 84 formed therein which is identical in size and shape to the rim 40 of the shell holder 30 which is inserted in the slot 42 of the ram 20 as illustrated in FIG. 2. Consequently, the rim 84 may be inserted in the slot 42 of the ram 20 thereby releasably securing the body 82 to the ram 20. The body 82 contains a threaded throughbore 86 which receives a cylindrical screw 88 so that the screw 88 projects from the end of the body 82 opposite the groove 84. Rotation of the screw 88 with respect to the body 82 is prevented by a setscrew 90 which is torqued against the screw 88. As best illustrated in FIG. 4, after the annular groove 84 is inserted in the slot 42 of the ram 20, the body 82 is rotated to thread the screw 88 into the threaded bore formed in the primer pocket 53. It is important to note, however, that rotation of the body portion 82 terminates when or before the end of the body 82 contacts the head 44 of the case 32 or the sizer die 16 so that no axial stress is placed on the screw 88 by rotation of the body 82. Thus, rotation of the body 82 and the screw 88 is not used to withdraw the case 32 from the die 16 but instead merely secures the expander device 80 to the case 32.

In contrast to conventional extracting techniques, the case 32 is then removed from the die 16 by rotating the handle 28 (FIG. 1) counterclockwise thereby applying an axial force between the case 32 and the sizer die 16. The connection between the screw 88 and the threads formed in the primer pocket 50 need only be strong enough to overcome the frictional force between the case 32 and sizer die 16. Significantly, it is not necessary that the contact between the screw 88 and threads in the primer pocket 50 be also strong enough to overcome the friction which would be produced by forcably rotating the screw 88 within the case 32. The hexagonal or other polygon shape of the body 82 allows the body 82 to be rotated by conventional wrench to facilitate insertion of the screw 88 in the primer pocket bore 50.

The inventive extracting device thus allows ammunition cases to be removed from sizer dies when the case is so firmly stuck in the die that conventional techniques would not be usable thereby necessitating either discard of the sizer die 16 or resort to time consuming and difficult manual techniques.

I claim:

1. A device for extracting an ammunition case from a sizer die in which said case has become stuck during sizing of said case with a reloading press, said case having a gripping rim and a primer pocket formed at its head, said press including a frame in which said sizing die and a reloading ram are mounted in spaced-apart, coaxial relation, a shell holder carried by said ram having an annular rim on one face received by a mounting slot formed at one end of said ram and a slot at the opposite face of said shell holder adapted to receive said gripping rim; and means for moving said ram between a first position in which said case is inserted in said sizer die and a second position in which said case is withdrawn from said sizer die, said extracting device comprising a generally cylindrical body having an annular rim at one end adapted for insertion in the mounting slot and a screw projecting from the opposite end of said body adapted for insertion in a threaded bore formed in the primer pocket of said case such that stuck cases may be removed from said sizer die by boring a hole in said primer pocket, tapping said bore to form screw threads therein, removing said case holder from said ram before inserting the rim formed in the body of said extracting device in the mounting slot of said ram, rotating said body to insert said screw into the threaded bore formed in said primer pocket, and moving said ram from its first position to its second position to withdraw said case from said sizer die.

2. The extracting device of claim 1 wherein said body is in the shape of a polygon to form planar faces along the sides of said body to facilitate rotation of said body with a wrench.

3. The extracting device of claim 1 wherein said screw is threaded into a threaded bore formed along the axis of said body, and said device further includes a second screw threaded into said bore and forcibly contacting the first screw to prevent rotation of said first screw.

4. The method of extracting an ammunition case having a primer pocket from a sizer die in which said case has become stuck, comprising boring a hole through the primer pocket of said case, tapping said bore to form threads therein, threading a screw projecting from an extractor body into said bore by rotating said body, terminating rotation of said body before rotation of said body places a substantial axial force on said screw and applying an axial force between said sizer die and said extractor body to withdraw said ammunition case from said sizer die.

5. The method of claim 4 further including the steps of mounting said sizer die on a frame of a reloading press, securing said extractor body to a reloading ram of said reloading press and axially moving said reloading ram away from said sizer die.

6. The method of claim 5 wherein said extractor body is in the shape of a polygon and wherein said method further includes the step of rotating said extractor body with a wrench to thread said screw into the threaded bore formed in the primer pocket of said case.

* * * * *